US006890161B2

(12) United States Patent
Paukovits, Jr. et al.

(10) Patent No.: US 6,890,161 B2
(45) Date of Patent: May 10, 2005

(54) DISPOSABLE FLUID DELIVERY SYSTEM

(75) Inventors: Edward J. Paukovits, Jr., Hummelstown, PA (US); Janet J. Hoffner, Halifax, PA (US); Richard V. Spong, Enola, PA (US)

(73) Assignee: Assistive Technology Products, Inc., Harrisburg, PA (US)

( * ) Notice: Subject to any disclaimer, the term of this patent is extended or adjusted under 35 U.S.C. 154(b) by 0 days.

(21) Appl. No.: 10/404,963

(22) Filed: Mar. 31, 2003

(65) Prior Publication Data

US 2004/0191086 A1 Sep. 30, 2004

(51) Int. Cl.[7] ..... F04B 43/12
(52) U.S. Cl. ..... 417/477.1; 222/325; 222/383.2
(58) Field of Search ..... 222/206, 207, 222/214, 215, 333, 325, 383.1, 383.2; 417/360, 474, 476, 477.1, 477.8; 604/153

(56) References Cited

U.S. PATENT DOCUMENTS

| | | | | | |
|---|---|---|---|---|---|
| 2,394,154 | A | * | 2/1946 | Curtis et al. | 222/383.2 |
| 2,898,864 | A | * | 8/1959 | Japolsky | 417/477.1 |
| 3,649,138 | A | * | 3/1972 | Clay et al. | 417/477.8 |
| 4,135,647 | A | * | 1/1979 | Mascia et al. | 222/383.2 |
| 4,138,205 | A | | 2/1979 | Wallach | |
| 4,178,138 | A | | 12/1979 | Iles | |
| 4,519,754 | A | | 5/1985 | Minick | |
| 4,537,561 | A | | 8/1985 | Xanthopoulos | |
| 4,545,744 | A | | 10/1985 | Weber et al. | |
| 4,824,339 | A | | 4/1989 | Bainbridge et al. | |
| 4,832,585 | A | | 5/1989 | Horiuchi | |
| 4,861,242 | A | | 8/1989 | Finsterwald | |
| 4,886,431 | A | | 12/1989 | Soderquist et al. | |
| 5,000,351 | A | * | 3/1991 | Rudick | 222/214 |
| 5,044,902 | A | | 9/1991 | Malbec | |
| 5,049,048 | A | | 9/1991 | Streicher | |
| 5,257,917 | A | | 11/1993 | Minarik et al. | |
| 5,356,267 | A | | 10/1994 | Fulmer | |
| 5,375,984 | A | | 12/1994 | Wehling | |
| 5,387,088 | A | | 2/1995 | Knapp et al. | |
| 5,447,417 | A | | 9/1995 | Kuhl et al. | |
| 5,549,458 | A | | 8/1996 | Chapman et al. | |
| 5,836,927 | A | | 11/1998 | Fried | |
| 6,120,263 | A | | 9/2000 | Kosters | |
| 6,212,959 | B1 | | 4/2001 | Perkins | |
| 6,213,739 | B1 | | 4/2001 | Phallen et al. | |
| 6,296,863 | B1 | | 10/2001 | Trogolo et al. | |
| 6,413,059 | B1 | | 7/2002 | Pringle | |
| 6,416,293 | B1 | | 7/2002 | Bouchard et al. | |
| 6,436,422 | B1 | | 8/2002 | Trogolo et al. | |
| 6,565,819 | B1 | * | 5/2003 | Herrera | 422/292 |
| 6,651,849 | B2 | * | 11/2003 | Schroeder et al. | 222/383.2 |

FOREIGN PATENT DOCUMENTS

| | | | |
|---|---|---|---|
| FR | 2672279 | * | 8/1992 |

* cited by examiner

*Primary Examiner*—Michael Koczo, Jr.
(74) *Attorney, Agent, or Firm*—Duane Morris LLP

(57) ABSTRACT

A fluid delivery system is provided having a disposable fluid reservoir that is integral with, and supported by, a pump housing. A peristaltic pump head is mounted within the pump housing. A length of flexible tubing is operatively engaged by the peristaltic pump, and includes a first end arranged in flow communication with the fluid reservoir and an accessible second end. A central portion of the tube is operatively engaged by the peristaltic pump head so that consecutive portions of the flexible tubing are successively collapsed to thereby propel fluid through the tubing so as to exit the second end. The disposable cartridge is preferably mateable with a recess in a base housing. A transmission system is mounted within the recess of the base housing and arranged to operatively engage the peristaltic pump head. A control module is disposed in control communication with the transmission system for selective operation of the fluid delivery system.

23 Claims, 12 Drawing Sheets

DISPOSABLE FLUID DELIVERY SYSTEM

FIELD OF THE INVENTION

The present invention generally relates to fluid delivery systems, and more particularly, to a peristaltic pump-cartridge and reservoir for pumping fluid through a length of tube.

BACKGROUND OF THE INVENTION

There exist many instances where a liquid in a container is to be dispensed repeatedly in the same, pre-measured quantity. One such situation is the dispensing of a liquid to a user in a medical or assisted living environment, e.g., home care, nursing home, hospital, etc. In the foregoing settings, there have typically been two different methods for dispensing exactly-repeated quantities of a liquid to a user. The first method consists of carefully pouring the liquid into a measurement container to obtain the desired amount, then having the person drink. The chief disadvantages of this method are that an additional tool, the measurement container, must be provided and the fluid has to be manually poured into the containers increasing the chances of spillage.

A second method consists of controlling the outlet of a liquid container by a tap and measuring the dispensed amount of liquid by reading the liquid level on a scale on the liquid container. Since the liquid container has to be held exactly vertically in order to correctly read the level of the liquid, and since at least one hand is needed in order to control the tap, this method is mainly restricted to liquid containers installed at a fixed location and is not convenient for small transportable bottles in a assisted care setting. Moreover, there is no record of refills with this method, and therefore it is often difficult to accurately determine the total consumption of liquid dispensed. Additionally, at least a part of the container needs to be transparent in order to observe the level of liquid. One other prevalent problem associated with such methods is the eventual warming and stagnation of the fluid. This causes the liquid to be less than desirable for ingestion by a person.

Peristaltic pumps are preferred for certain liquid dispensing applications due to their ability to pump fluids without any contact between the pump's components and the fluid. Roller-type peristaltic pumps are frequently encountered in laboratory, instrumentation, and light commercial settings. In a typical roller-type peristaltic pump system, one or more lengths of flexible tubing are contacted by a series of rollers that are mounted on a rotor so as to be capable of moving in a circular path, i.e., a circumferential, circular arc, over the tubing. The flexible tube is compressed between rollers and a circular backstop or race. The race has a surface adjacent to, and concentric with, the path of the rollers. As the occluded portion of the tube is advanced, the fluid in front of it is forced to travel through the tube. The rotor may be rotated by a variable-speed motor or other suitable drive. Peristaltic pump systems are known to offer very limited tubing life.

It would be of great advantage to have a liquid container capable of repeatedly dispensing a controlled, defined volume of liquid without using an additional measurement container or a tap. Additionally, it would be very convenient if dispensing a defined amount of liquid were continuously adjustable, with only minimum manual control of the apparatus necessary to establish the desired volume of liquid. It would be further advantageous if the dispensing of liquid to a person in a medical setting could be repeated until the container is empty, without any need of additional operations to be carried out, and with the rate, volume, and time of dispensing recordable and selectively controllable. Also, recirculation of the liquid through appropriate filters and cooling systems so as to prevent the warming and stagnation of the fluid, would provide a distinct advantage over the prior art.

SUMMARY OF THE INVENTION

The present invention provides a fluid delivery system comprising a disposable fluid reservoir that is integral with, and supported by, a pump housing with a peristaltic pump mounted within the pump housing. A length of flexible tubing is operatively engaged by the peristaltic pump, and includes a first end arranged in flow communication with the fluid reservoir and an accessible second end. A central portion of the tube is operatively engaged by the peristaltic pump so that consecutive portions of the flexible tubing are successively collapsed to thereby propel fluid through the tubing so as to exit the second end. The disposable cartridge is preferably mateable with a recess in a base housing. A transmission system is mounted within the recess of the base housing and arranged to operatively engage the peristaltic pump. A control module is disposed in control communication with the transmission system for selective operation of the fluid delivery system.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENTS

Figure 1:
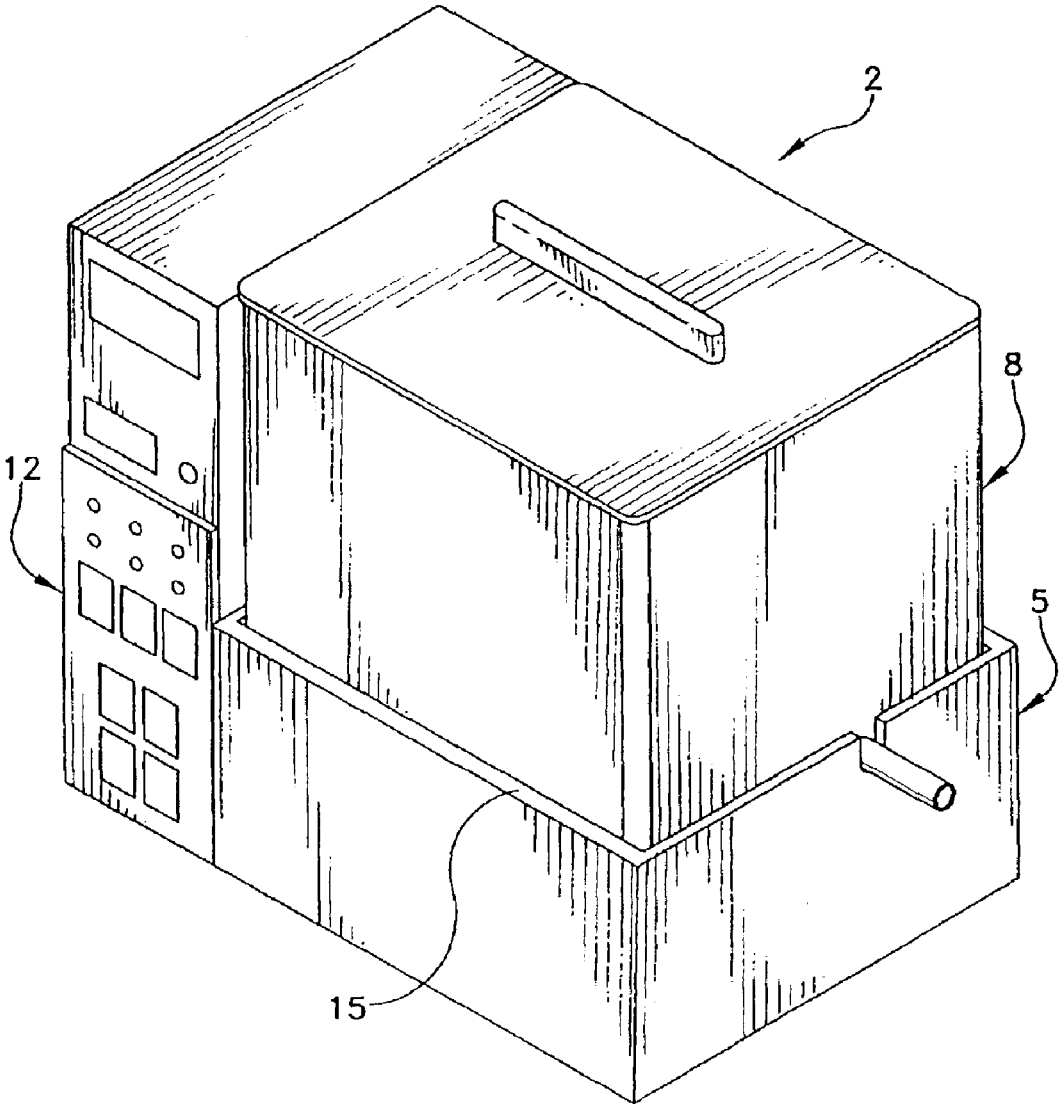
FIG. 1 is a perspective view of a peristaltic pump-cartridge, base housing and controls for a fluid delivery system formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Figure 2:
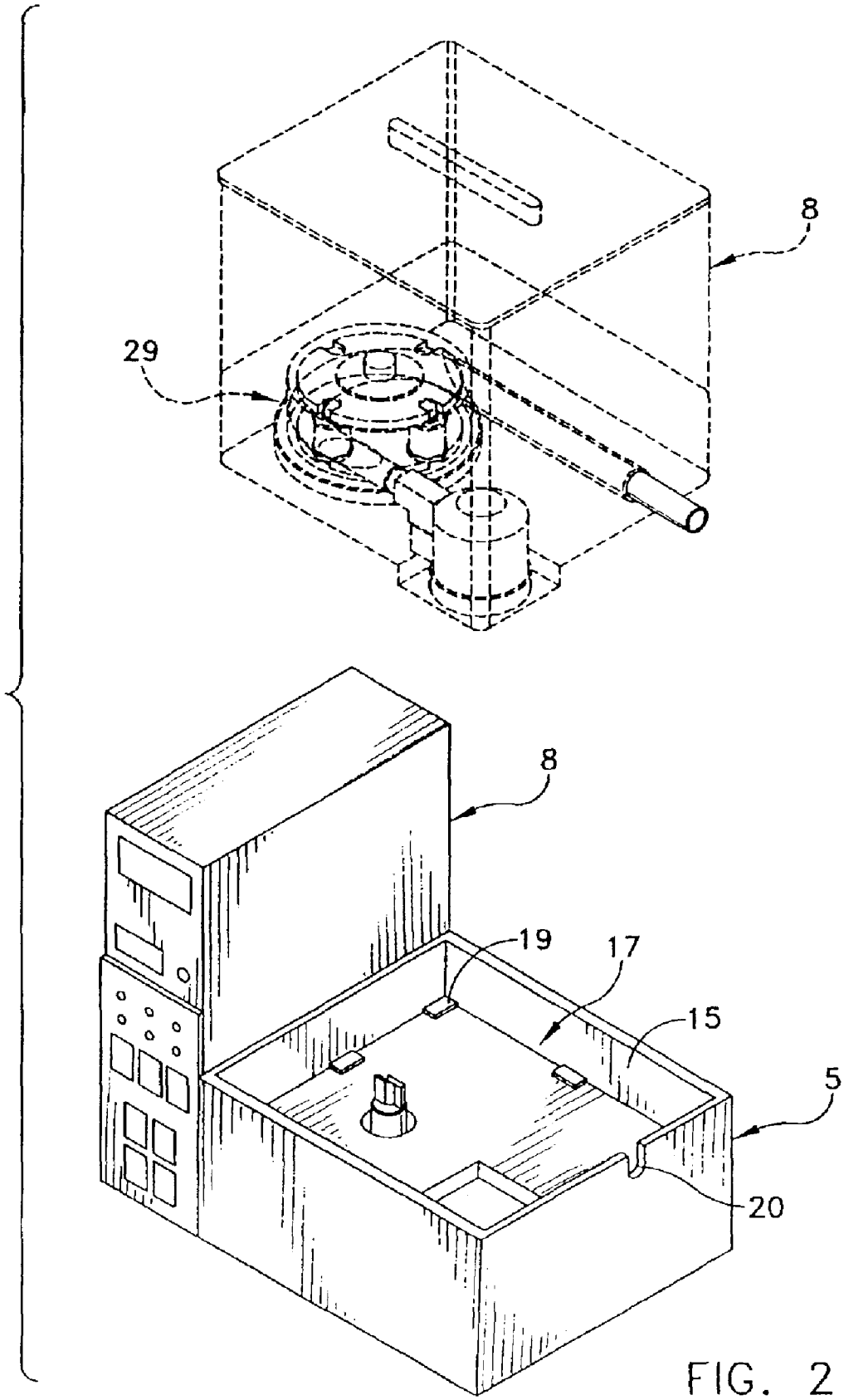
FIG. 2 is an exploded perspective view, partially in phantom, of the peristaltic pump cartridge shown in FIG. 1.
Figure 3:
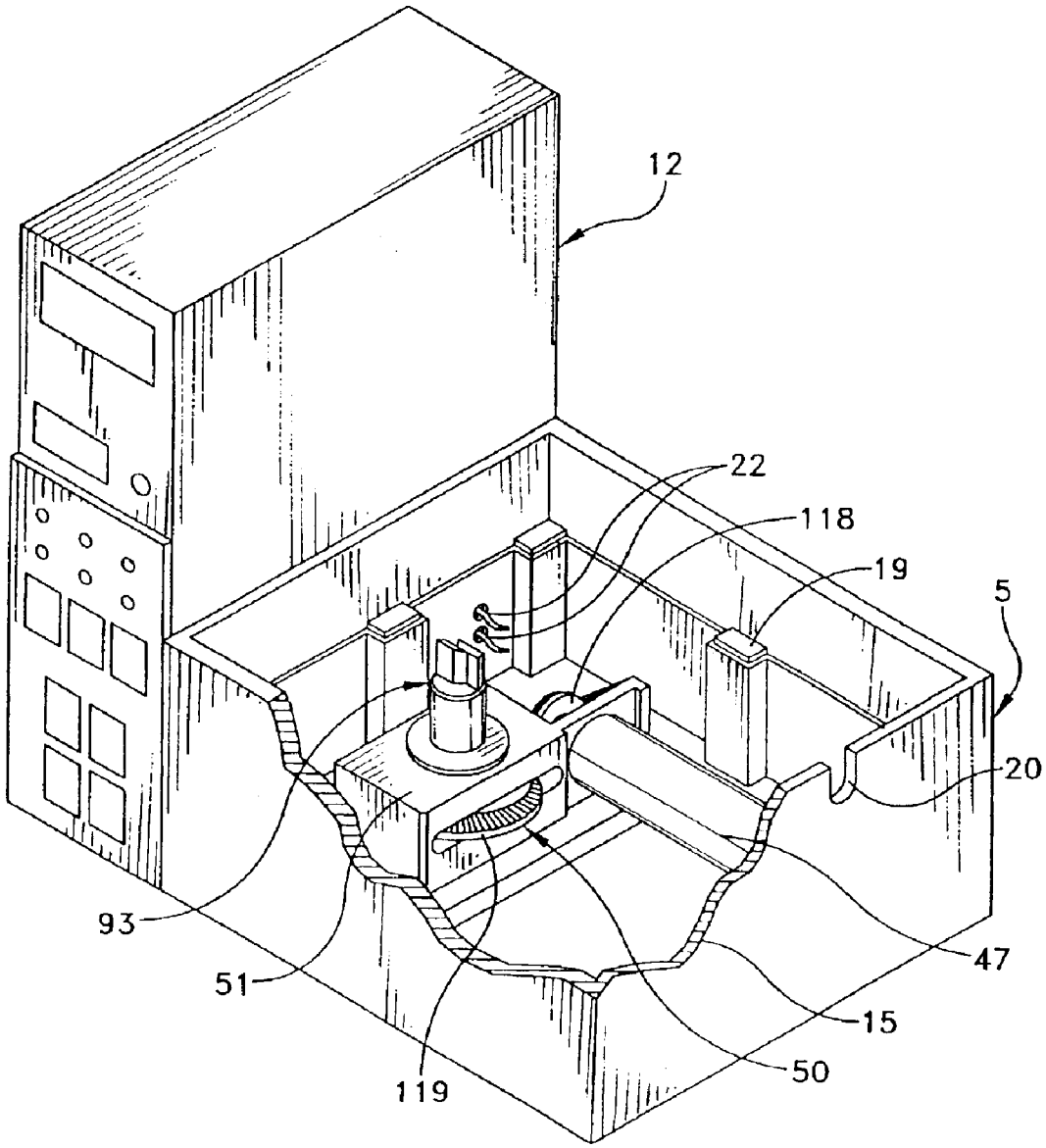
FIG. 3 is a perspective view, partially broken-away, of a base housing and control module of the present invention.
Figure 4:
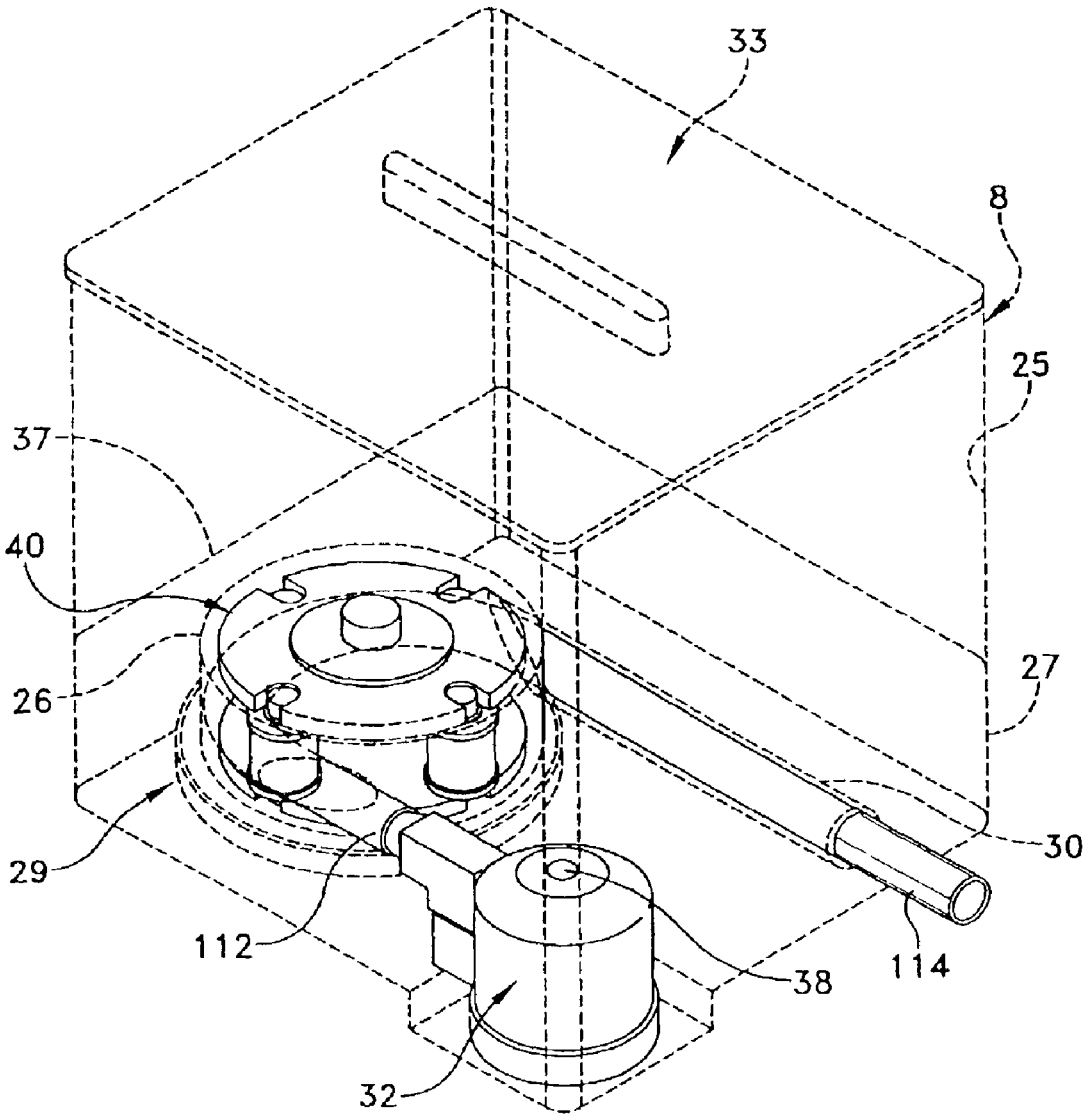
FIG. 4 is a perspective view, partially in phantom, of a peristaltic pump cartridge formed in accordance with the present invention.

Referring to FIGS. 1–3, a peristaltic pump-cartridge, fluid delivery system 2 formed in accordance with the present invention generally comprises a base 5, a reservoir cartridge 8, and a control module 12. More particularly, base 5 has a generally rectilinear profile including an annular wall 15 that surrounds a central recess 17 (FIGS. 2). Stops 19 are periodically positioned on the interior surface of wall 15 so as to support portions of reservoir cartridge 8. A slot 20 extends into a top portion of wall 15 at a first end of base 5, and a plurality of through-bores 22 are defined through a bottom portion of wall 15 at a second end of base 5, adjacent to control module 12, to accommodate conventional electrical interconnection (FIG. 3). Base 5 may be formed from one of the well known polymer materials that are suitable for use in structures requiring mechanical strength and integrity, e.g., but without limitation, thermoplastics (crystalline or non-crystalline, cross-linked or non-cross-linked), thermosetting resins, or blends or composites thereof, including polyhalo-olefins, polyamides, polyolefins, polystyrenes, polyvinyls, polyacrylates, polymethacrylates, polyesters, polydienes, polyoxides, polyamides and polysulfides and their blends, co-polymers and substituted derivatives thereof. Of course, other engineering materials suitable for support structures may also be used in connection with the present invention, e.g., metals, ceramics, and composites.

Figure 5:
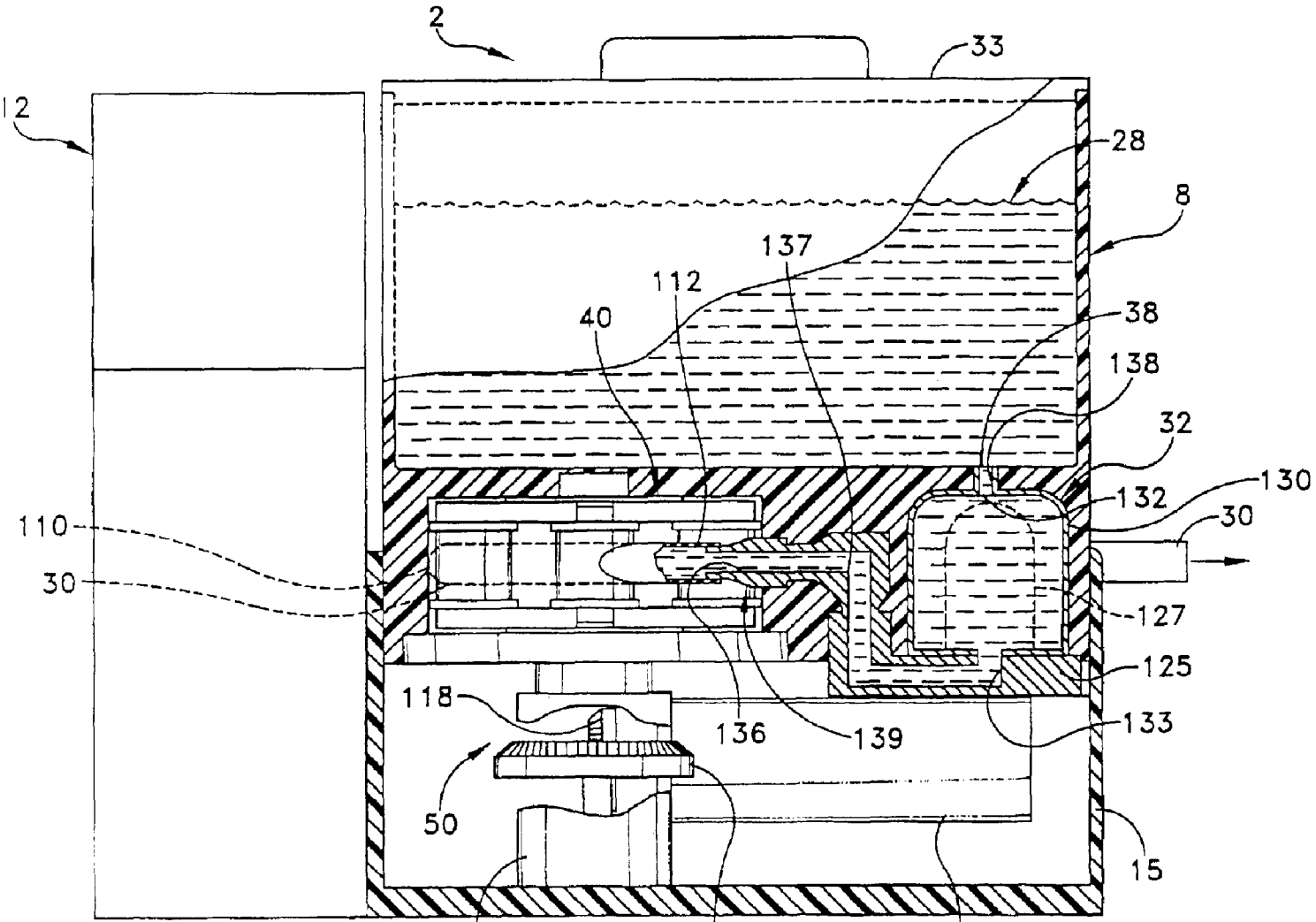
FIG. 5 is a side elevational view of the peristaltic pump cartridge shown in FIGS. 1 and 2, shown partially in cross-section for clarity of illustration.
Figure 6:
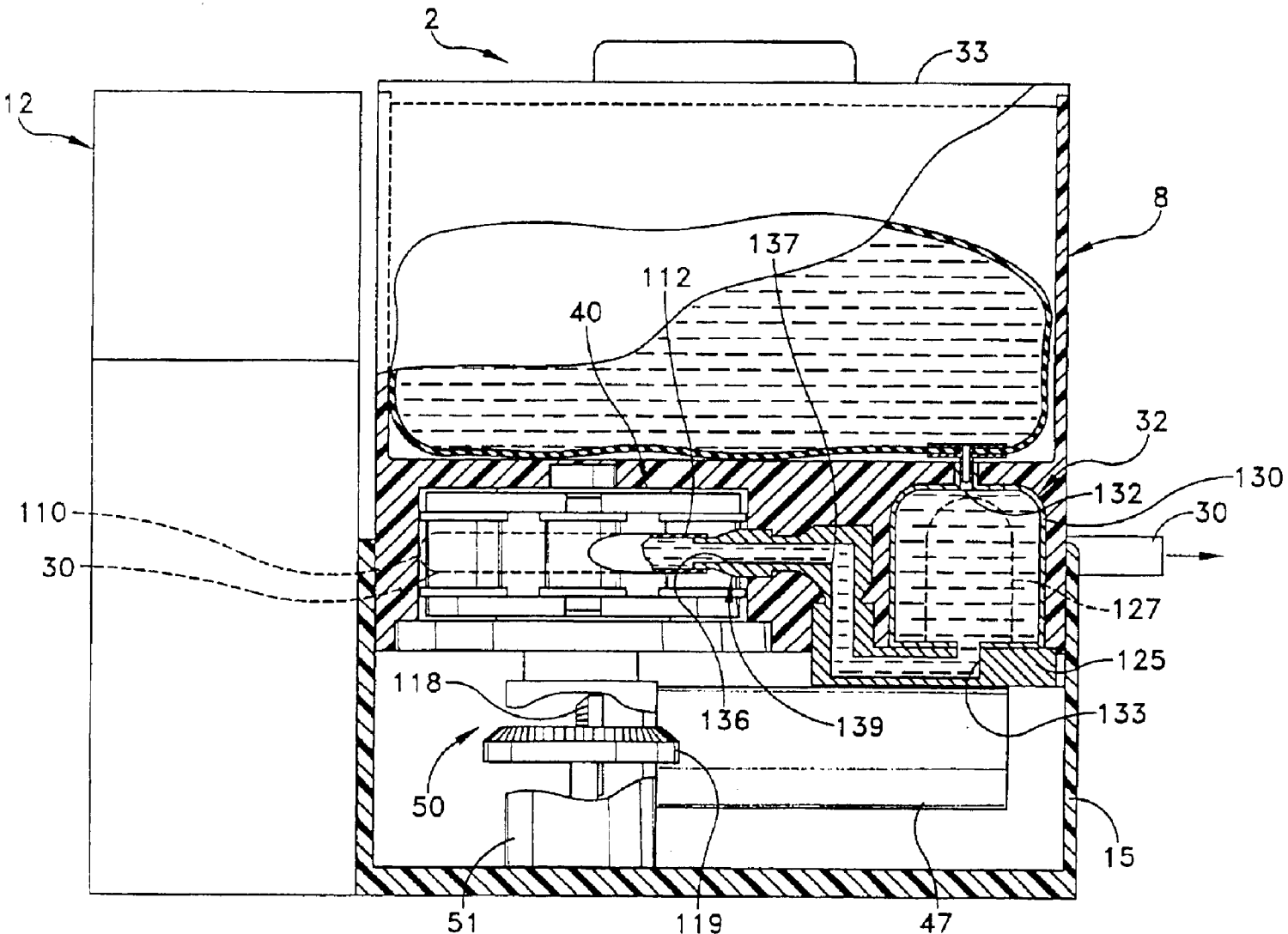
FIG. 6 is a side elevational view of the peristaltic pump cartridge shown in FIGS. 1 and 2, shown partially in cross-section for clarity of illustration, and illustrating a fluid delivery bag.
Figure 7:
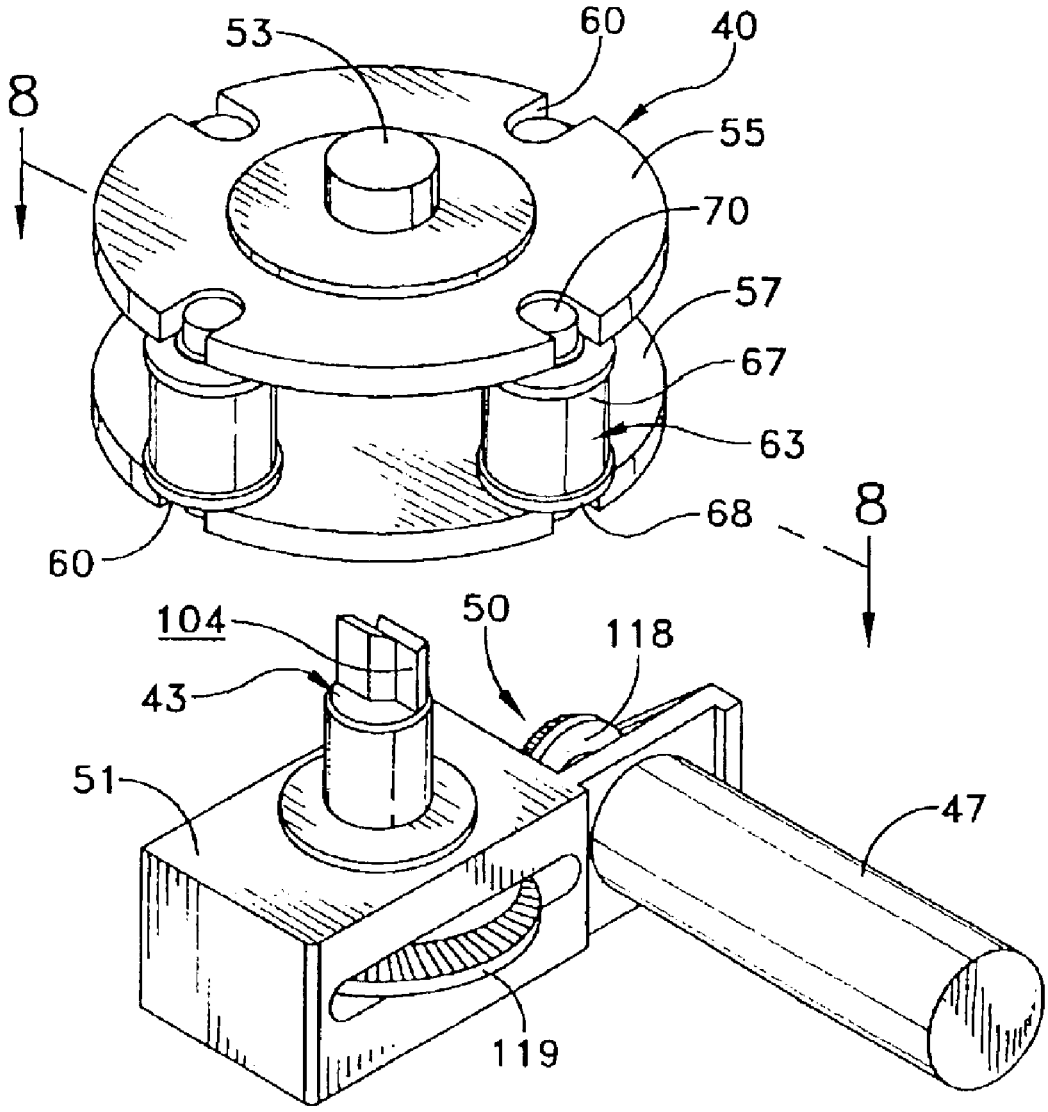
FIG. 7 is a perspective, partially exploded, view of a pump head assembly and transmission system.

Referring to FIGS. 1, 2, and 4–7, reservoir cartridge 8 includes a fluid reservoir 25, a pump housing 27, a pump head assembly 29, a flexible tubing or hose 30 and a filtration assembly 32. Fluid reservoir 25 comprises an open ended receptacle capable of supporting a predetermined quantity of fluid 28, e.g., water, medication, etc. It is often covered by a removable lid 33. A fluid bag 31 may also be used by placing it within fluid reservoir 25 and arranged in fluid flow communication with flexible hose 30 (FIG. 6). Pump housing 27 is also formed as an open ended receptacle disposed under fluid reservoir 25, and includes a race 26, i.e., a curved, interior wall formed as a course along which a fluid is conveyed within flexible hose 30 (FIGS. 2, 4, 10 and 12). Fluid reservoir 25 and pump housing 27 are often integrally formed with one another so that a common wall 37 separates fluid reservoir 25 from pump housing 27. Common wall 37 includes one or more through-holes 38 (FIG. 4) that allow for fluid communication between interior portions of fluid reservoir 25 and pump housing 27.

Figure 8:
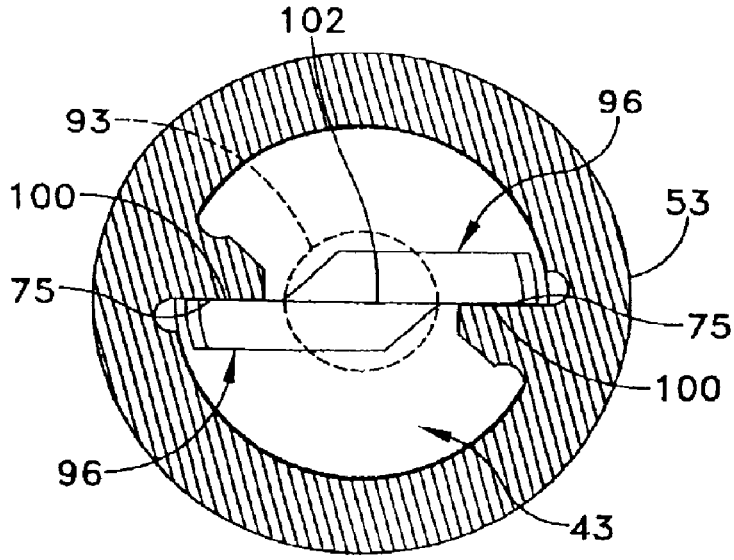
FIG. 8 is a cross-sectional view of a central spindle mounted upon a drive shaft.
Figure 9:
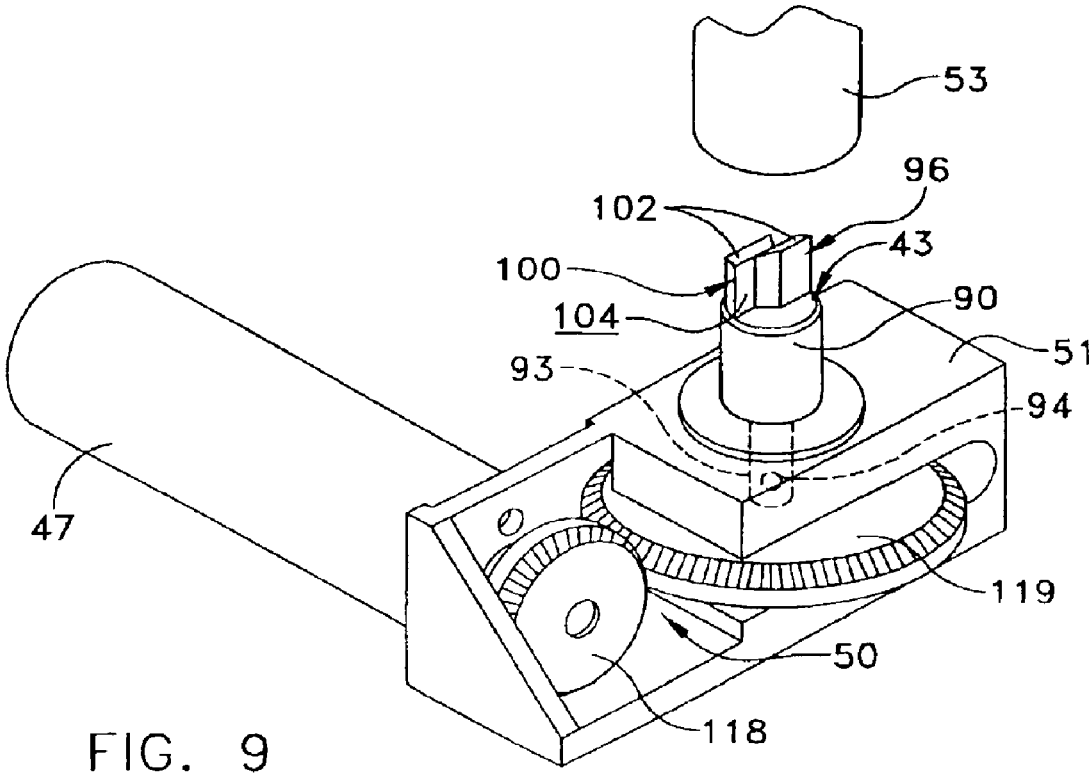
FIG. 9 is a perspective view of a portion of the transmission system shown FIG. 6.

Referring to FIGS. 6–8 and 10, pump head assembly 29 comprises a rotor 40 that includes a central spindle 53 having a top flange 55 positioned at one end, and a bottom flange 57 positioned at another end in spaced relation to top flange 55. Top flange 55 and bottom flange 57 comprise circular disks that each have a plurality of slots 60 defined in their edges and arranged in circumferentially spaced relation to one another, e.g., at 90° intervals around the circumference of each circular flange. A plurality of rollers 63 are positioned between top flange 55 and bottom flange 57, and include a cylindrical spindle 67 and a pair of spaced apart flanges 68, one positioned at each end of cylindrical spindle 67. A pair of axles 70 project outwardly from each end of spindle 67. Axles 70 are sized, shaped, and arranged on each roller 63 so that they may be rotatably received within a pair of corresponding slots 60 in top flange 55 and bottom flange 57 of rotor 40. Central spindle 53 includes a blind hole 72 that is defined along the longitudinal axis of rotor 40. A pair of diametrically opposed teeth 75 project radially inwardly from the surface that defines blind hole 72. Each tooth 75 includes a chamfered top 76 (FIGS. 8 and 12).

Referring to FIGS. 6–9, transmission system 50 includes a drive shaft 43 and a motor 47 that are supported on block 51. Drive shaft 43 includes a body 90, a gear pin 93, and a key 96. Body 90 often comprises a metal cylinder with gear pin 93 projecting outwardly from one end and key 96 projecting outwardly from the other end. Gear pin 93 is typically formed as a shaft that is sized and shaped so as to be operatively connected to a portion of transmission system 50. For example, a hole 94 may be defined through a portion of gear pin 93 that is sized and shaped to accept a fastener (not shown) so as to lock gear pin 93 in place within transmission system 50. Key 96 comprises a pair of substantially identical blades 100 that are arranged in back-to-back, off-set relation to one another on the end of body 90. Each blade 100 includes a downwardly inclined top surface 102 and tooth engagement surface 104. Top surfaces 102 of each blade intersect so as to form a recessed groove in the top portion of key 96 that provides a "lead-in" chamfer. This construction compensates for the situation where the rotational position of drive shaft 43 orients surfaces 102 so as to be out of axial alignment with teeth 75 upon engagement with the pump-cartridge.

Pump head assembly 29 is driven by motor 47 that is operatively connected to transmission system 50. Motor 47 may comprise a servo-motor of the type well known for use in consumer appliances. A motor that has been found to provide adequate results is the one manufactured by Maxon Precision Motors, Inc., of Burlingame, Calif., under the tradename A-Max 22. Transmission system 50 also includes a pair of helical gears 118 and 119 that are operatively engaged with one another. Helical gear 118 is mounted on motor 47 and helical gear 119 is arranged within support block 51 so as to operatively engage gear pin 93 of drive shaft 43. Motor 47 is arranged in electrical communication with both control module 12 and an appropriate power supply, via through-bores 22 (not shown) of the type well known for providing electrical energy to motors.

Figure 10:
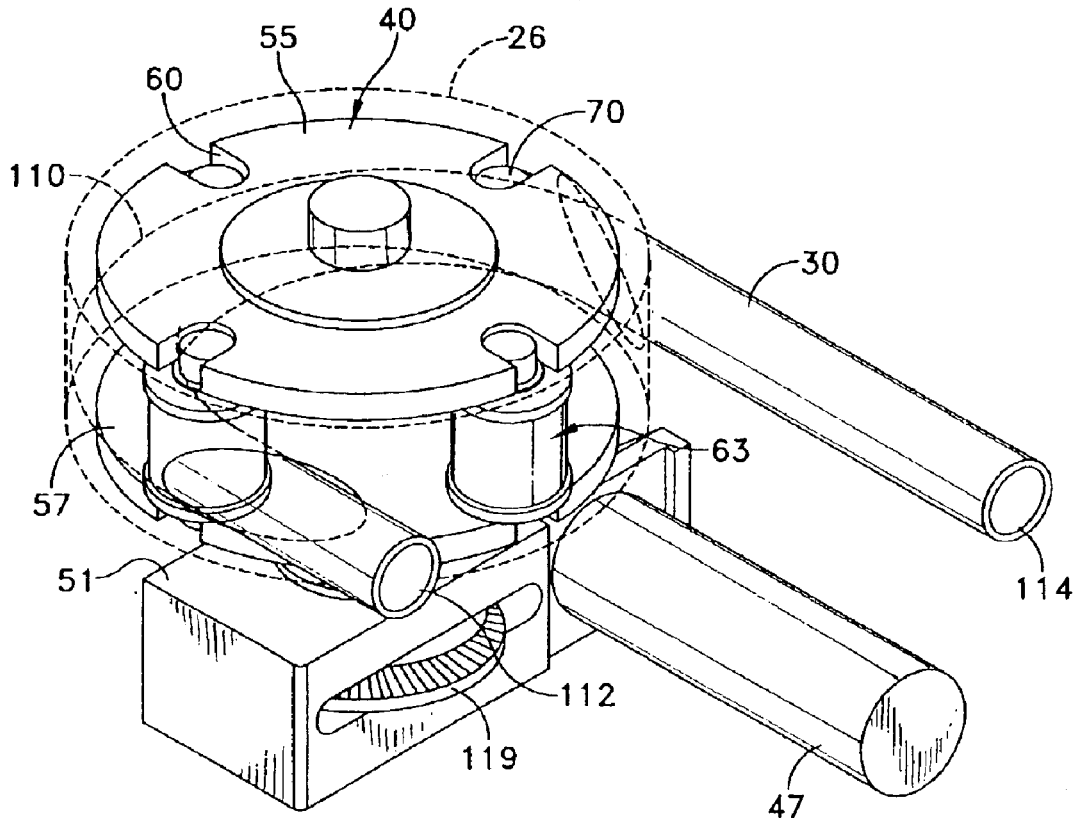
FIG. 10 is a perspective view of the pump head assembly and transmission system shown in FIG. 6, with a flexible tube positioned between a plurality of rollers and a race.
Figure 11:
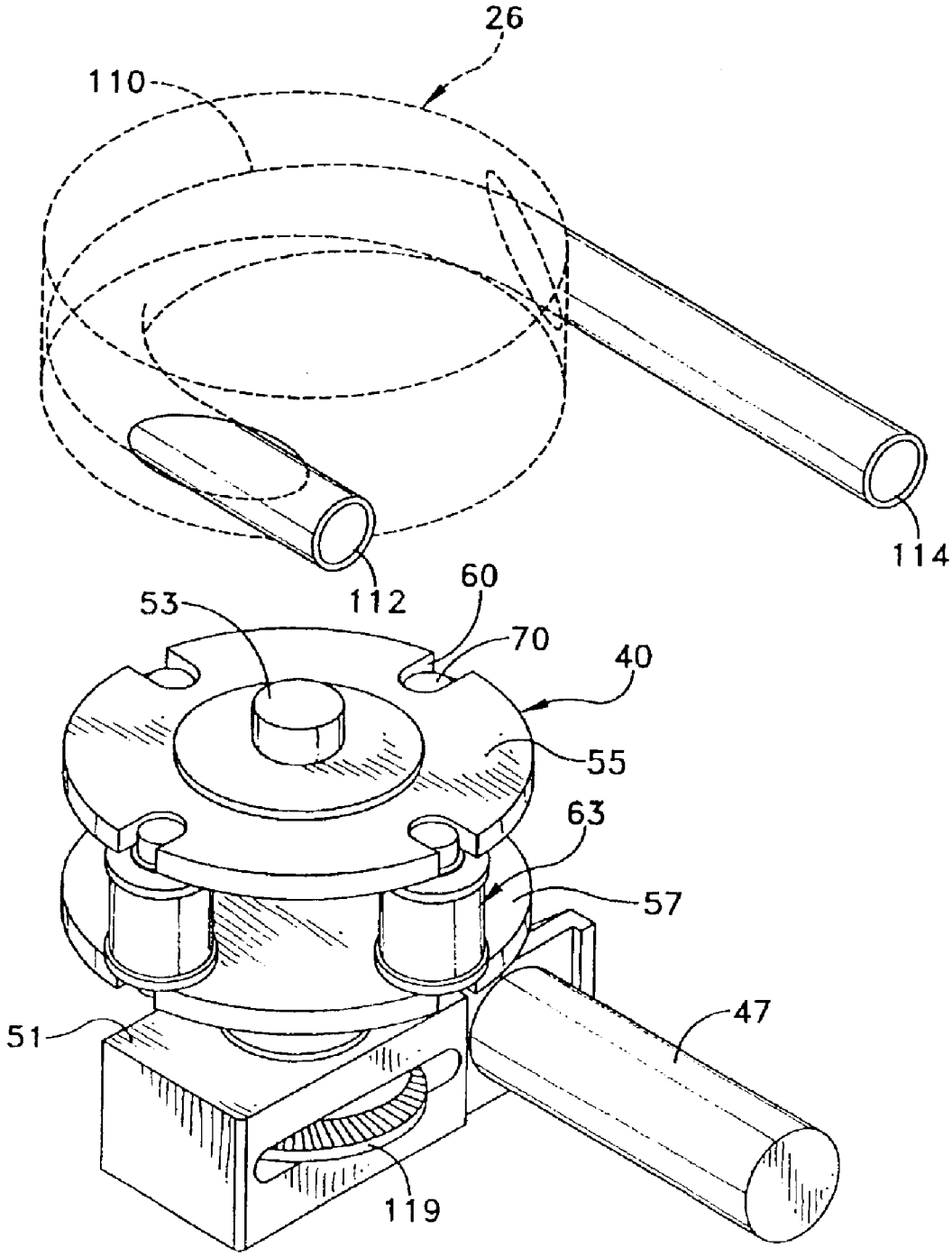
FIG. 11 is a perspective view of the pump head assembly and transmission system shown in FIG. 9, with the race and tube shown partially in phantom and exploded-away for clarity of illustration.
Figure 12:
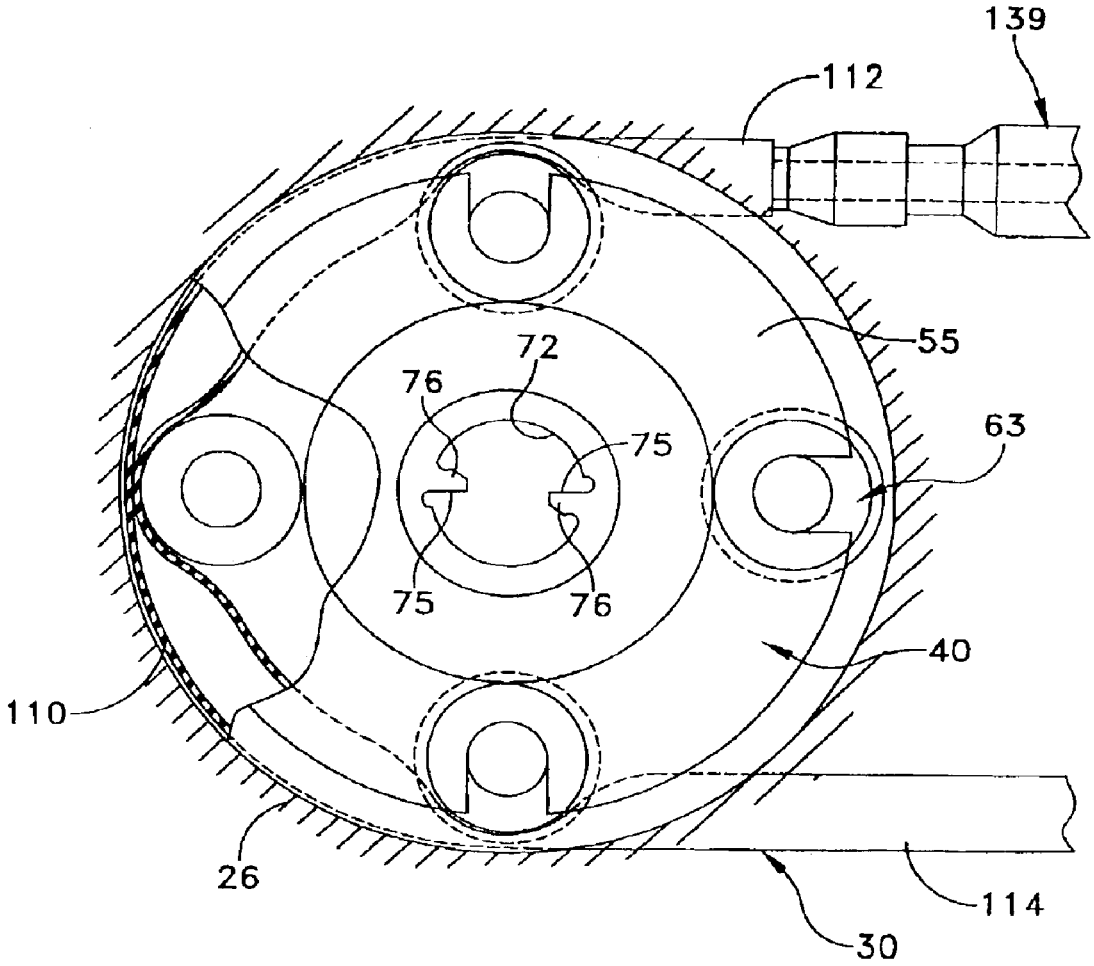
FIG. 12 is a bottom view of a rotor showing the internal features of the central spindle.

Referring to FIGS. 2, 4, 11 and 12 flexible hose 30 comprises a tube that is often formed from a resilient elastomeric material, and includes a central portion 110, a head end 112, and a trail end 114. Head end 112 is disposed in fluid communication with a portion of filtration assembly 32 and trail end 114 exits pump housing 27 through slot 20. Central portion 110 is positioned between race 26 and rollers 63 (FIGS. 10–12).

Figure 13:
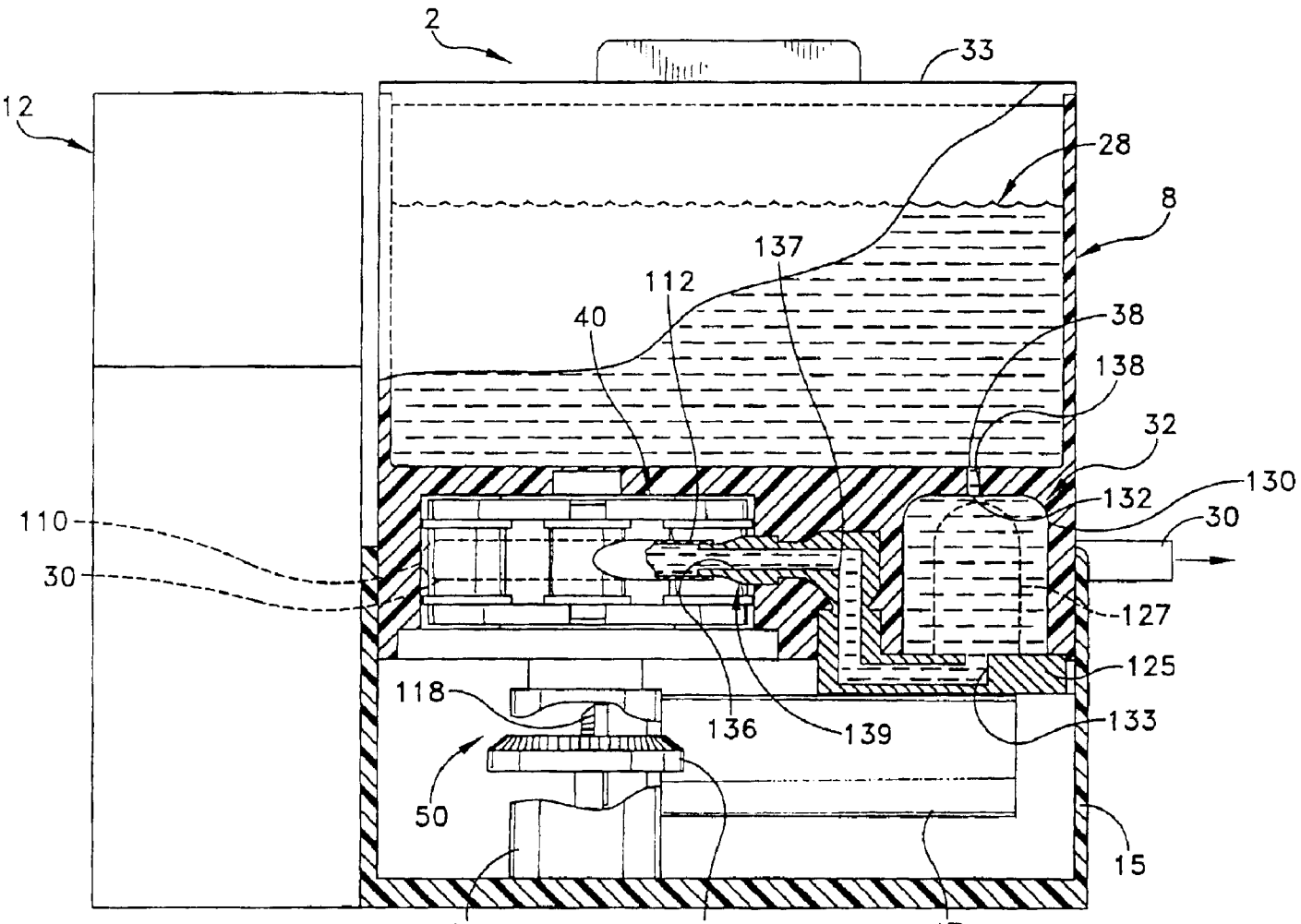
FIG. 13 is a side elevational view of an alternative embodiment of peristaltic pump cartridge shown in FIGS. 1 and 2, shown partially in cross-section for clarity of illustration.

Referring to FIG. 5, filtration assembly 32 includes a base 125, a filter medium 127, and a cover 130. More particularly, base 125 is often circularly shaped, and includes a central opening 133 that leads to a head opening 136 through a passageway 137. An interface fitting 139 is positioned at head opening 136 so as to provide for interconnection of head end 112 of flexible hose 30 with filtration assembly 32. Filter medium 127 often has a closed, hollow cylindrical profile or dome shape with a diameter at an open end that is substantially the same as the diameter of base 125. For example, the gravity filters manufactured by SafeWater Anywhere of Ashland, Oreg. have been found to provide adequate results when used with the present invention. Such filters often comprise antimicrobial compounds that slowly release silver ions into the filtered fluid. These silver ions act as broad-spectrum antimicrobial agents and are highly effective when eradicating many types of bacteria and mold. Cover 130 has a shape and size that complement the shape and size of filter medium 127, i.e., a closed, hollow cylindrical profile or dome shape with a diameter at an open end that is substantially the same as the diameter of base 125. An opening 138 is defined in a top portion of cover 130 to allow filtration assembly 32 to be arranged in flow communication with the interior of fluid reservoir 25, via through-holes 38 in common wall 37. Although a separate cover 130 has been found to provide adequate results, it is preferred to form cover 130 integrally with housing 27 (FIG. 13).

Control module 12 includes an arrangement of known electronic components that together may store and execute instructions for the operation of motor 47 and the recording of rate and time of delivery of fluid. Control system 12 provides for the control and initiation for the priming of fluid delivery system 2, the basic operation of pump head assembly 29 and transmission system 50, and the monitoring of fluid output. This monitoring is in ml while in a Normal Mode of operation, or in ml/hr while in Control Mode operation. The Control Mode feature gives the user the option for programming and monitoring set requirements for maximum or minimum ml/hr output of fluid to be allowed for a particular user. If these preselected limits are exceeded by the user, or not met, respectively, both a flashing led and an audible alert located within control module 12 are activated. Additionally, the fluid output amounts are stored in memory until reset, and may be viewed on a display as either ml in Normal Mode, or Total ml/ Elapsed Time, in Control Mode.

In operation, reservoir cartridge 8 is assembled to base 5 by first positioning reservoir cartridge 8 in confronting relation to central recess 17 of base 5. In this position, blind hole 72 of central spindle 53 is positioned in coaxially aligned relation to key 96 of drive shaft 43. From this position, reservoir cartridge 8 is moved toward base 5 such that key 96 enters blind hole 72 of central spindle 53. Reservoir cartridge 8 continues toward base 5 until it engages stops 19. It may be necessary to advance drive shaft 43 slightly in order to effect proper seating of key 96. When reservoir cartridge 8 is fully seated within recess 17 of base 5, trail end 114 of flexible hose 30 extend outwardly through slot 20 in annular wall 15 of base 5. At the same time, key 96 of drive shaft 43 is positioned within blind hole 72 of central spindle 53 of rotor 40 (FIG. 8).

When motor 47 is activated by control module 12, transmission system 50 operates to rotate drive shaft 43 into engagement with rotor 40. More particularly, as drive shaft 43 rotates, surfaces 104 of key 96 engage teeth 75 so as to rotate rotor 40 and initiate the priming of fluid delivery system 2. As transmission system 50 drives rotor 40, fluid is dispensed according to a preprogrammed scheme which is monitored and recorded by control module 12 in Normal Mode or Control Mode operation.

It is to be understood that the present invention is by no means limited only to the particular constructions herein disclosed and shown in the drawings, but also comprises any modifications or equivalents within the scope of the claims.

What is claimed is:

1. A disposable cartridge for a fluid delivery system comprising:

a fluid reservoir integral with and supported by a pump housing so that a common wall separates said fluid reservoir from said pump housing and includes at least one through-hole that allows for fluid communication between interior portions of said fluid reservoir and said pump housing, wherein said pump housing is formed as an open ended receptacle including a curved, interior wall formed as a course;

a peristaltic pump mounted within said pump housing; and a length of flexible tubing having a first end arranged in flow communication with said fluid reservoir, an accessible second end, and a central portion positioned within said course and operatively engaging said peristaltic pump so that consecutive portions of said flexible tubing are successively collapsed to thereby propel fluid through said tubing and along said course so as to exit said second end.

2. A disposable cartridge for a fluid delivery system according to claim 1 wherein said fluid reservoir comprises an open ended receptacle capable of supporting a predetermined quantity of fluid.

3. A disposable cartridge for a fluid delivery system according to claim 1 wherein said fluid reservoir comprises an open ended receptacle that supports a fluid delivery bag containing said fluid and arranged in fluid flow communication with said length of flexible tubing.

4. A disposable cartridge for a fluid delivery system according to claim 1 wherein said curved, interior wail defines an arc.

5. A disposable cartridge for a fluid delivery system according to claim 1 wherein said rotor includes a plurality of rollers are rotatably mounted between said top flange and said bottom flange within said slots and operatively engaging consecutive portions of said length of flexible tubing.

6. A disposable cartridge for a fluid delivery system comprising:

a fluid reservoir integral with and supported by a pump housing;

a peristaltic pump mounted within said pump housing said peristaltic pump comprising a rotor including a central spindle having a top flange positioned at one end and a bottom flange positioned at another end in spaced relation to said top flange wherein each of said top and bottom flanges have a plurality of slots defined in their edges and arranged in circumferentially spaced relation to one another, and further wherein said central spindle includes a blind hole that is defined along a longitudinal axis of said rotor, and including a pair of diametrically opposed teeth that project radially inwardly from a surface of said central spindle that defines said blind hole, said teeth including a chamfered top; and a length of flexible tubing having a first end arranged in flow communication with said fluid reservoir, an accessible second end, and a central portion operatively engaging said peristaltic pump so that consecutive portions of said flexible tubing are successively collapsed to thereby propel fluid within said passageway through said tubing so as to exit said second end.

7. A fluid delivery system according to claim 6 wherein said fluid reservoir comprises an open ended receptacle that supports a fluid delivery bag containing said fluid and arranged in fluid flow communication with said length of flexible tubing.

8. A fluid delivery system comprising:

a fluid reservoir integral with and supported by a pump housing;

a peristaltic pump head mounted within said pump housing;

a length of flexible tubing having a first end arranged in flow communication with said fluid reservoir, an accessible second end, and a central portion operatively engaging said peristaltic pump head so that consecutive portions of said flexible tubing are successively collapsed to thereby propel fluid within said passageway through said tubing so as to exit said second end;

a base housing including a recess sized to accept a portion of said pump housing;

a transmission system mounted within said recess and arranged to operatively engage said peristaltic pump; and a control module disposed in control communication with said transmission system.

9. A fluid delivery system according to claim 8 wherein said transmission system includes a drive shaft projecting outwardly from a gear system that is mounted to a support block disposed within said recess wherein said transmission system is operatively powered by a motor.

10. A fluid delivery system according to claim 9 wherein said transmission system includes a drive shaft having a gear pin projecting from a first end and a key projecting from a second end wherein said gear pin is operatively connected to a portion of said transmission system and said key comprises a pair of substantially identical blades that are arranged in back-to-back, off-set relation to one another on said second end of said drive shaft.

11. A fluid delivery system according to claim 10 wherein each said blade includes a downwardly inclined top surface and a tooth engagement side surface.

12. A fluid delivery system according to claim 8 wherein said pump housing is formed as an open ended receptacle disposed under said fluid reservoir and including a curved, interior wall formed as a course along which said fluid is conveyed within a portion of said length of flexible tubing and said peristaltic pump head comprises a rotor positioned adjacent to said curved, interior wall and including a central spindle having a top flange positioned at one end and a bottom flange positioned at another end in spaced relation to said top flange wherein each of said top and bottom flanges have a plurality of slots defined in their edges and arranged in circumferentially spaced relation to one another and including a plurality of rollers rotatably mounted between said top flange and said bottom flange within said slots and operatively engaging consecutive portions of said length of flexible tubing.

13. A fluid delivery system according to claim 12 wherein said curved, interior wall defines an arc.

14. A fluid delivery system according to claim 12 wherein said central spindle includes a blind hole that is defined along a longitudinal axis of said rotor, and including a pair of diametrically opposed teeth that project radially inwardly from a surface of said central spindle that defines said blind hole.

15. A fluid delivery system according to claim 14 wherein each of said teeth includes a chamfered top.

16. A fluid delivery system according to claim 12 wherein said length of flexible tubing includes a head end disposed in fluid communication with said fluid reservoir and a trail end that exits said pump housing.

17. A fluid delivery system according to claim 16 wherein said central portion is positioned between said curved interior wall and said rollers.

18. A fluid delivery system comprising:

a fluid reservoir integral with and supported by a pump housing;

a peristaltic pump head mounted within said pump housing wherein said pump housing is formed as an open ended receptacle disposed under said fluid reservoir and including a curved, interior wall formed as a course along which said fluid is conveyed within a portion of a length of flexible tubing positioned adjacent to said curved wall, and wherein said peristaltic pump head comprises a rotor positioned adjacent to said curved wall and including a central spindle having a top flange positioned at one end and a bottom flange positioned at another end in spaced relation to said top flange wherein each of said top and bottom flanges have a plurality of slots defined in their edges and arranged in circumferentially spaced relation to one another and including a plurality of rollers rotatably mounted between said top flange and said bottom flange within said slots and operatively engaging consecutive portions of said length of flexible tubing;

said length of flexible tubing having a first end arranged in flow communication with said fluid reservoir through a filtration assembly, an accessible second end, and a central portion operatively engaging said peristaltic pump head so that consecutive portions of said flexible tubing are successively collapsed to thereby propel fluid within said passageway through said tubing so as to exit said second end;

a base housing including a recess sized to accept a portion of said pump housing;

a transmission system mounted within said recess and arranged to operatively engage said peristaltic pump head; and a control module disposed in control communication with said transmission system.

19. A fluid delivery system according to claim 18 wherein said filtration assembly is positioned within said pump housing, and includes a base that supports a filter medium and a cover formed integrally with said pump housing.

20. A fluid delivery system according to claim 19 wherein said base includes a central opening that leads to a head opening through a passageway having an interface fitting that is positioned at said head opening so as to provide for interconnection with an open end of said flexible tubing.

21. A fluid delivery system according to claim 20 wherein said filter medium comprises a closed, hollow dome shape with a diameter at an open end that is smaller then the diameter of said base and said cover has a shape and size that complement the shape and size of said filter medium.

22. A fluid delivery system according to claim 21 wherein an opening is defined in a top portion of said cover to allow filtration assembly to be arranged in flow communication with the interior of said fluid reservoir.

23. A fluid delivery system according to claim 21 wherein said filter medium slowly releases silver ions when filtering a fluid from said fluid reservoir.

* * * * *